US009940759B2

(12) United States Patent
Takenaka et al.

(10) Patent No.: US 9,940,759 B2
(45) Date of Patent: Apr. 10, 2018

(54) DRIVE DATA COLLECTION SYSTEM

(71) Applicant: DENSO CORPORATION, Kariya, Aichi-pref. (JP)

(72) Inventors: Kazuhito Takenaka, Kariya (JP); Takashi Bando, Kariya (JP); Masumi Egawa, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 207 days.

(21) Appl. No.: 14/940,190

(22) Filed: Nov. 13, 2015

(65) Prior Publication Data

US 2016/0140779 A1 May 19, 2016

(30) Foreign Application Priority Data

Nov. 14, 2014 (JP) ..... 2014-231796
Oct. 30, 2015 (JP) ..... 2015-214442

(51) Int. Cl.
*G07C 5/00* (2006.01)
*G07C 5/08* (2006.01)

(52) U.S. Cl.
CPC ..... *G07C 5/008* (2013.01); *G07C 5/0816* (2013.01)

(58) Field of Classification Search
CPC .... G07C 5/085; G07C 5/008; G07C 2205/02; G07C 5/0891; G07C 5/0808; G07C 5/0825; B60K 35/00
See application file for complete search history.

(56) References Cited

U.S. PATENT DOCUMENTS

2008/0147266 A1* 6/2008 Plante ..... G07C 5/008 701/33.4
2008/0147267 A1* 6/2008 Plante ..... G07C 5/008 701/33.4
2010/0057361 A1* 3/2010 Caveney ..... B60W 30/08 701/301

FOREIGN PATENT DOCUMENTS

JP 2013-250663 12/2013
JP 2014-235605 12/2014

OTHER PUBLICATIONS

"Initial Analyses From the SHRP 2 Naturalistic Driving Study," Transportation Research Board of the National Academies, by Hallmark et al., 2013, pp. 1-29.

(Continued)

*Primary Examiner* — Jelani Smith
(74) *Attorney, Agent, or Firm* — Harness, Dickey & Pierce, P.L.C.

(57) ABSTRACT

A drive data collection system includes an in-vehicle system and an information center. The in-vehicle system includes a data collector that repeatedly collects measurement values indicative of various indexes regarding a state of a subject vehicle, a model memory that memorizes model information regarding discretization rules that are shared by each of participating vehicles in the system, and a data discretizer that discretizes drive data, which includes time-series measurement values collected by the data collector, into multiple data parts according to the model information. The information center includes a data accumulator that accumulates the discretized drive data in a server. The in-vehicle system sends the discretized drive data to the information center through a communicator. Therefore, the drive data collection system efficiently collects the drive data in a versatilely-utilizable manner for the analysis of general driving practices/behaviors.

10 Claims, 9 Drawing Sheets

(56) References Cited

OTHER PUBLICATIONS

"Naturalistic Driving Study: Field Data Collection," Transportation Research Board of the National Academies, by Blatt et al., May 1, 2014, pp. i-157.

* cited by examiner

DRIVE DATA COLLECTION SYSTEM

CROSS REFERENCE TO RELATED APPLICATION

The present application is based on and claims the benefit of priority of Japanese Patent Applications No. 2014-231796, filed on Nov. 14, 2014, and No. 2015-214442, filed on Oct. 30, 2015, the disclosures of which are incorporated herein by reference.

TECHNICAL FIELD

The present disclosure generally relates to a drive data collection system for collecting a large amount of data regarding a drive of a vehicle.

BACKGROUND INFORMATION

Naturalistic Driving Study (NDS) is known as an attempt to utilize a large amount of data collected from every driving, in a "natural" setting, of a vehicle by using in-vehicle sensors or the like, for an analysis of driver's characteristics and for an evaluation of a risk in the driving, as well as a look-ahead driving support or the like. See, for example, a non-patent document, S. Hallmark, D. McGehee, K. M. Bauer, J. M. Hutton, G. A. Davis, J. Hourdos, I. Chatterjee, T. Victor, J. Bargman, M. Dozza, H. Rootzen and J. D. Lee, C. Ahlstrom, O. Bagdadi, J. Engstrom, D. Zholud, and M. Ljung-Aust, "Initial Analyses from the SHRP2 Naturalistic Driving Study: Addressing Driver Performance and Behavior in Traffic Safety," SHRP 2 Research Reports, SHRP 2 Safety Project S08, Transportation Research Board of the National Academies, 2013.

In NDS, to versatilely utilize the collected data from everyday driving for various purposes, the drive data must be collected in every aspect of driving behavior or the like, without limiting/restricting the data type or driving situations, which may have already been tried and tested in a conventional probe car system that collects only a special purpose drive data.

In the conventional study of NDS, the data measurement and accumulation device is installed in a cooperator's vehicle, and the device is collected from the cooperator's vehicle after the collection of the raw drive data, to obtain the collected data.

However, if, in prospect, vehicles in general were targeted by NDS for such drive data collection with no-specific situations, the installation and collection of the data measurement device from the vehicles is not realistic.

Instead, the data collection from general vehicles may be performed via a communication network by wireless communication, which is more probable in terms of collecting drive data from many vehicles and accumulating the collected data in an information center.

The data from only one vehicle may be, however, pretty much large or may add up to a vast amount, since an attempt such as the NDS or similar studies does not put a restriction on the data type of the collected drive data, which may be a burden of the communication network.

SUMMARY

It is an object of the present disclosure to provide a technique that enables an efficient data collection from in-vehicle devices when versatile drive data regarding various aspects of the driving practice and/or behavior is collected from a vehicle.

In an aspect of the present disclosure, a drive data collection system includes an in-vehicle system installed in a vehicle. The in-vehicle system includes a data collector repeatedly collecting measurement values indicative of various indexes regarding a state of a subject vehicle that has the in-vehicle system installed in the subject vehicle, a model memory that memorizes model information regarding discretization rules for discretizing drive data into multiple data parts, the drive data includes time-series measurement values collected by the data collector, and the multiple data parts are shared by each of participating vehicles in the system, and a data discretizer that discretizes the drive data into the multiple data parts according to the model information.

The drive data collection system also includes an information center that communicates with the in-vehicle system. The information center includes a data accumulator that accumulates the discretized drive data in a server. The in-vehicle system sends the discretized drive data to the information center via communication through a communicator.

That is, in present disclosure, the in-vehicle system does not transmit the raw (i.e., as-is) data to the information center, but transmits the discretized data that is transformed to the discretized drive data for the data accumulation in the server. Therefore, the amount of communication between the in-vehicle system and the information center, and the storage capacity requirement of the server are reduced, thereby enabling an efficient data collection when versatile drive data (e.g., multipurpose drive data, or data not only for specific predefined purposes) is collected by the system.

Further, the in-vehicle system on each of the participating vehicles uses the same model information when discretizing the drive data, thereby enabling the discretized drive data to have the same format (i.e., the structure of the discretized drive data is standardized based on a single standard or criterion), and enabling an easy data integration and/or the data analysis.

The parenthesized numerals in the claims show only an example relationship between the claim element and a concrete component, and do not limit the scope of the present disclosure.

BRIEF DESCRIPTION OF THE DRAWINGS

Objects, features, and advantages of the present disclosure will become more apparent from the following detailed description made with reference to the accompanying drawings, in which.

DETAILED DESCRIPTION

The embodiment of the present disclosure is described in the following with reference to the drawings.

(First Embodiment)

[Configuration]

Figure 1:
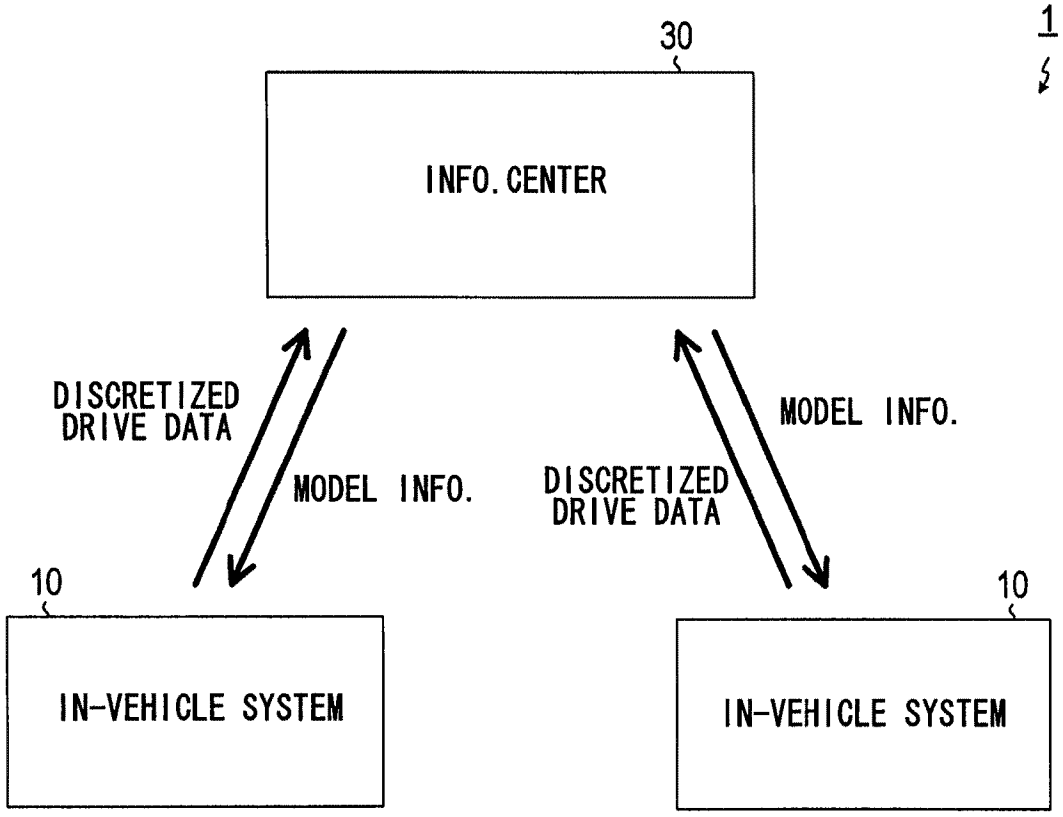
FIG. 1 is a block diagram of a performance data collecting system in a first embodiment of the present disclosure.

A drive data collection system 1 shown in FIG. 1 is provided with an in-vehicle system 10 disposed in each vehicle in the system, and an information center 30 that is capable of performing wireless communications with the in-vehicle system 10.

[In-Vehicle System]

Figure 2:
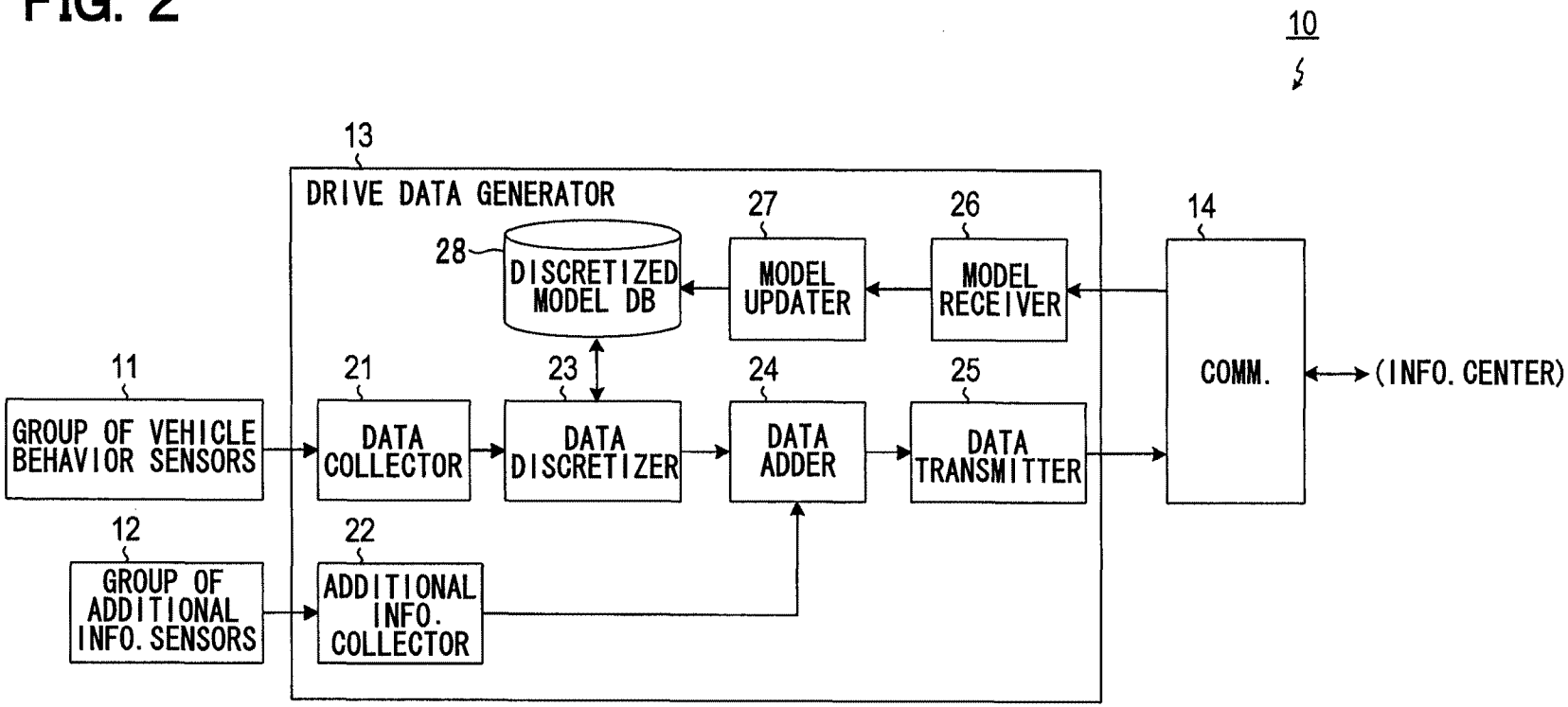
FIG. 2 is a block diagram of an in-vehicle system in the first embodiment of the present disclosure.

The in-vehicle system 10 is provided with a group of vehicle behavior sensors 11, a group of additional information sensors 12, a drive data generator 13, and a communicator 14, as shown in FIG. 2.

The group of vehicle behavior sensors 11 consists of the various devices for detecting information about a vehicle behavior itself and/or information about a drive operation and the like which affect the vehicle behavior. The detection object regarding which the group of vehicle behavior sensors 11 detects the above-described information is, for example, an operation amount of an accelerator pedal or a brake pedal, a steering angle, a vehicle speed, a vehicle acceleration and the like.

The group of additional information sensors 12 consists of the various devices for detecting information about a situation in which a subject vehicle is placed. For example, the detection object regarding which the group of additional information sensors 12 detects the above-described information is position information of the subject vehicle, image information that captures a surrounding and/or a vehicle compartment in the subject vehicle, a present destination of navigation or an automatic driving, route information regarding a travel toward the destination, environment information regarding weather and/or traffic condition and the like.

The communicator 14 is used for communication between the in-vehicle system 10 and the information center 30, and the communication between the in-vehicle system 10 and the information center 30 may be a direct communication, or may be a communication via a public communication network or the like.

The drive data generator 13 is provided with a data collector 21, an additional information collector 22, a data discretizer 23, a data adder 24, a data transmitter 25, a model receiver 26, a model updater 27, and a discretized model database (DB) 28.

The drive data generator 13 is realized as a device such as a microcomputer including a Central Processing Unit (CPU), Read-Only Memory (ROM), and Random Access Memory (RAM), and the discretized model Data Base (DB) 28 is stored in the RAM. Further, each of the other components 21 to 27 is respectively realized by a process that is executed by the CPU according to a stored program in the ROM.

The data collector 21 repeatedly obtains an output of the group of vehicle behavior sensors 11. The additional information collector 22 repeatedly obtains additional information which is an output of the group of additional information sensors 12.

The data discretizer 23 makes drive data from a series of data that is obtained by the data collector 21, and discretizes the drive data into a plurality of data series respectively representing a certain drive scene based on the model information that is memorized by the discretized model DB 28.

Figure 3:
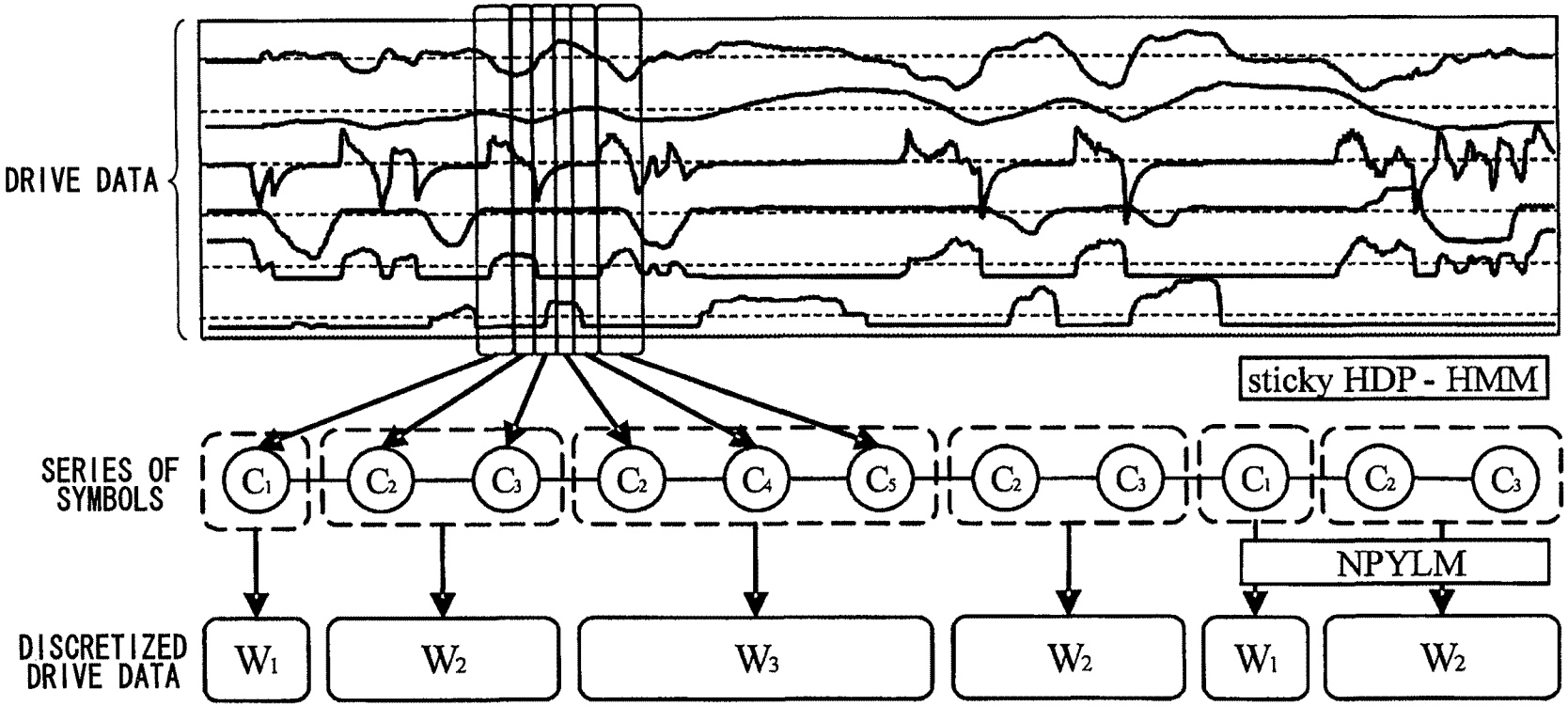
FIG. 3 is a diagram of a discretization process.

Discretization in this case is performed by using a Double Articulation Analyzer (DAA), which is a device for articulating (i.e., segmenting) the data by an unsupervised drive scene dividing method that utilizes a double articulation structure. That is, as shown in FIG. 3, first, a symbol is assigned (i.e., C1, C2, - - - ) to each of multi-dimensional measurement value patterns that repeatedly appear in the series of the drive data for generating a series of symbols, and the generated series of symbols is articulated into multiple partial series (i.e., W1, W2, - - - ) respectively representing a certain drive scene. The partial series are hereafter designated as discretized drive data.

More practically, in a DAA method, clusters representing various vehicle states that are gathered based on the drive data in a multi-dimensional space to depict value ranges of the drive data and transition probabilities between the clusters are defined in advance, and based on the clusters and the probabilities, which one of the various clusters the drive data obtained from the data collector 21 belongs to is statistically determined. In such manner, the series of the drive data are sorted/divided into the vehicle states, which is a unit of articulation. That is, the drive data is sorted by the clusters. Each of the clusters has a symbol of C1, C2 or the like assigned to the clusters, which means that the drive data in time series is converted to a series of symbols. For the generation of such a series of the symbols, Hierarchical Dirichlet Process Hidden Markov Model (HDP-HMM) may be utilized, where a modeling of hidden states and transition probabilities between the hidden states are contained, for example.

Next, in a DAA method, the generated series of symbols is articulated by using a Nested Pitman-Yor Language Model (NPYLM), which is an example of unsupervised chunking method of discrete text/character string based on the statistical information, into partial series that respectively mean certain driving scenes. In the course of such articulation, the generation probability of the entire sign series that is made up from the partial series is maximized. In such manner, the articulation of the drive data into the drive scenes is enabled. In such case, however, the transition probability between the partial series and the generation probability of the partial series used in the above method are pre-defined.

That is, in other words, when the DAA method is used, (A) the cluster used for the generation of the series of symbols and the transition probability between the clusters and (B) the transition probability between the partial series and the generation probability of the partial series that are respectively used for the articulation of the series of symbols are respectively used as the model information.

Further, the DAA method, which is an application of HDP-HMM or NPYLM is disclosed, for example, in a publication of JP 2013-250663 A or the like. Further, the articulation method for articulating the series of symbols, and the symbols series generation method are neither necessarily limited to HDP-HMM nor to NPYLM (i.e., the methods are open to any other method known in the art).

Returning to the description of FIG. 2, after the discretization of the data by the data discretizer 23 (i.e., the articulated series of symbols, which hereafter is designated as discretized drive data), the data adder 24 adds, to each of the discretized drive data, additional information that is obtained by the additional information collector 22 at the same timing as the discretized drive data.

More practically, the averaged value of the location information that are obtained at the same timing as the discretized drive data, and the image feature obtained from the image information, the information regarding the destination and/or the route, the surrounding traffic condition and a drive time and the like of the same timing may be added as the additional information.

Further, the data to be added may also be data other than information obtained by the additional information collector 22. That is, the data obtained by the data collector 21 may also be used as the additional information. More practically, the operation amount of the accelerator/brake pedal obtained at the same time, and the steering angle, the averaged value or a histogram of the vehicle speed and the vehicle acceleration of the same timing may also be added as the additional information.

The data transmitter 25 transmits the discretized drive data, which has the additional information added to the discretized drive data by the data adder 24 to the information center 30 via the communicator 14.

The model receiver 26 receives the model information from the information center 30 via the communicator 14. The model updater 27 updates the memory content of the discretized model DB 28 by the model information that is received by the model receiver 26.

[Information Center]

Figure 4:
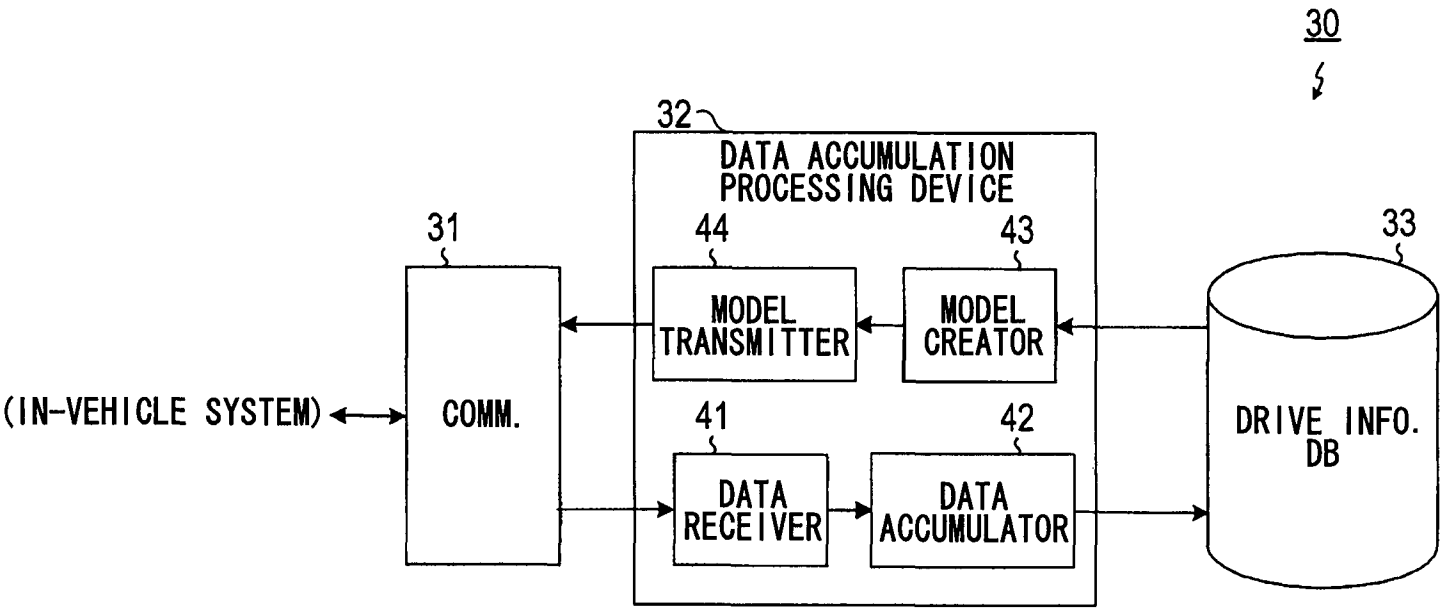
FIG. 4 is a block diagram of an information center in the first embodiment of the present disclosure.

The information center 30 is provided with a communicator 31, a data accumulation processing device 32, and a drive information DB 33 as shown in FIG. 4.

The communicator 31 realizes communication with the in-vehicle system 10, and may be configured to have a direct communication with the in-vehicle system 10, or may be configured to have a communication with the in-vehicle system 10 via a public communication network, etc.

The drive information DB 33 may be a large capacity memory device (e.g. a hard disk), and memorizes the discretized drive data to which the additional information is added. The discretized drive data having the additional data added to the discretized drive data may simply be designated as the "discretized drive data."

The data accumulation processing device 32 is provided with a data receiver 41, a data accumulator 42, a model creator 43, and a model transmitter 44.

The data accumulation processing device 32 is realized as a device such as a microcomputer including CPU, ROM, and RAM. Each of the components 41 to 44 in the processing device 32 is realized by a process that is executed by the CPU according to a stored program in the ROM.

The data receiver 41 receives the discretized drive data from the in-vehicle system 10 via the communicator 31.

The data accumulator 42 accumulates the discretized drive data that is received by the communicator 31 in the drive information DB 33. The accumulated drive data is sorted (i.e., in a classified/categorized manner) by the similarity of the situation, or the drive scenes, based on the additional information.

The model creator 43 creates model information that is used for the process in the data discretizer 23, when a certain amount of information is accumulated in the drive information DB 33.

The model transmitter 44 distributes/delivers the model information created by the model creator 43 to each of the in-vehicle systems 10 via the communicator 31. Thereby, the model information memorized in each of the vehicles is updated.

[Effects]

As described above, in the drive data collection system 1, the drive data detected by each of the vehicles is discretized by the in-vehicle system 10, and the discretized drive data is transmitted to the information center 30.

In other words, the discretized drive data, which is discretized and is thus compacted in data size compared with the pre-discretization drive data, is easy to be transmitted to the information center 30 via wireless communication, thereby enabling the collection of versatile drive data in an efficient manner, which includes various kinds of information.

Further, when the in-vehicle system 10 in each of the vehicles discretizes the drive data, common model information is used for the discretization. As a result, the discretized drive data from each of the vehicles has a standardized data structure, data integration and/or data analysis regarding the drive data collected from many vehicles is easily performable.

Further, the discretization of the drive data is performed based on the information about the vehicle behavior or based on the information about the drive operation and the like which affect the vehicle behavior, thereby enabling the compactness of the discretized drive data to have a suitable granularity according to the contents of the drive operation or the like.

For example, the drive data of a travel in one road section recording very few changes in the vehicle behavior is discretized into a data chunk to have a greater compactness (i.e., three symbols discretized into one data as shown in FIG. 3), and the drive data of a travel in the other road section recording various changes in the vehicle behavior is finely discretized to a smaller data chunk (i.e., one symbol discretized into one data in FIG. 3).

Further, the discretized drive data has the additional information associated with the discretized drive data, thereby enabling the easy extraction of the desired situation based on such additional information and improving the value (i.e., the versatility) of the discretized drive data.

For example, it may be easy for the system 1 to extract the discretized drive data regarding a travel of the vehicle in a certain region in a specific time slot. Further, based on the additional information associated with the travel of the vehicle, a frequently-observed driving behavior on such a specific condition or under certain circumstances may be further extracted and analyzed as a distribution of such behaviors in such time slot. Based on such analysis, a dangerous driving habit or similar experiences on such a specific condition or under certain circumstances is extracted and is provided for the driver as a feedback, or is utilized as a trigger for the facility management of the road or the like.

(Second Embodiment)

Since the system configuration in the second embodiment is fundamentally the same as the first embodiment, the same part between the two embodiments is omitted from the following description, and a focus of the description in put on the difference between the first embodiment and the second embodiment.

[Configuration]

Figure 5:
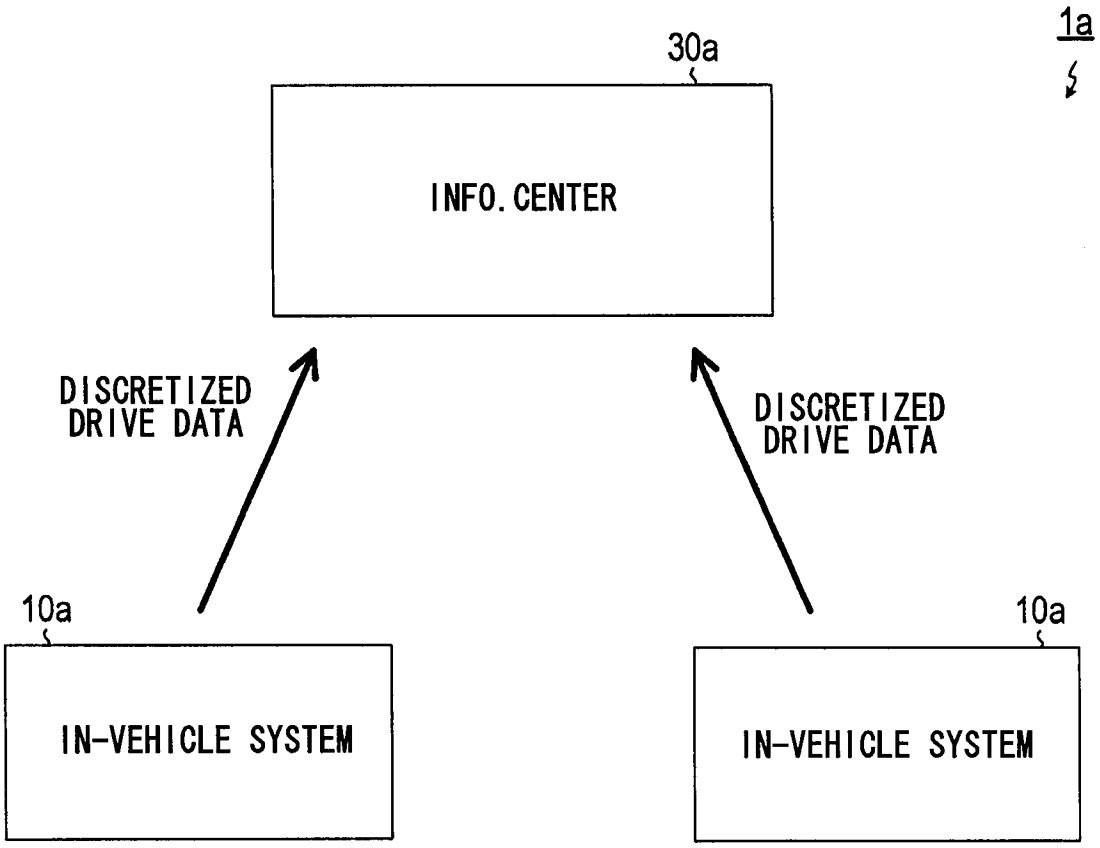
FIG. 5 is a block diagram of the performance data collecting system in the second embodiment of the present disclosure.

A drive data collection system 1*a* in FIG. 5 is provided with an in-vehicle system 10*a* in each of the many vehicles and the information center 30 that is capable of communicating with the in-vehicle system 10*a*.

[In-Vehicle System]

Figure 6:
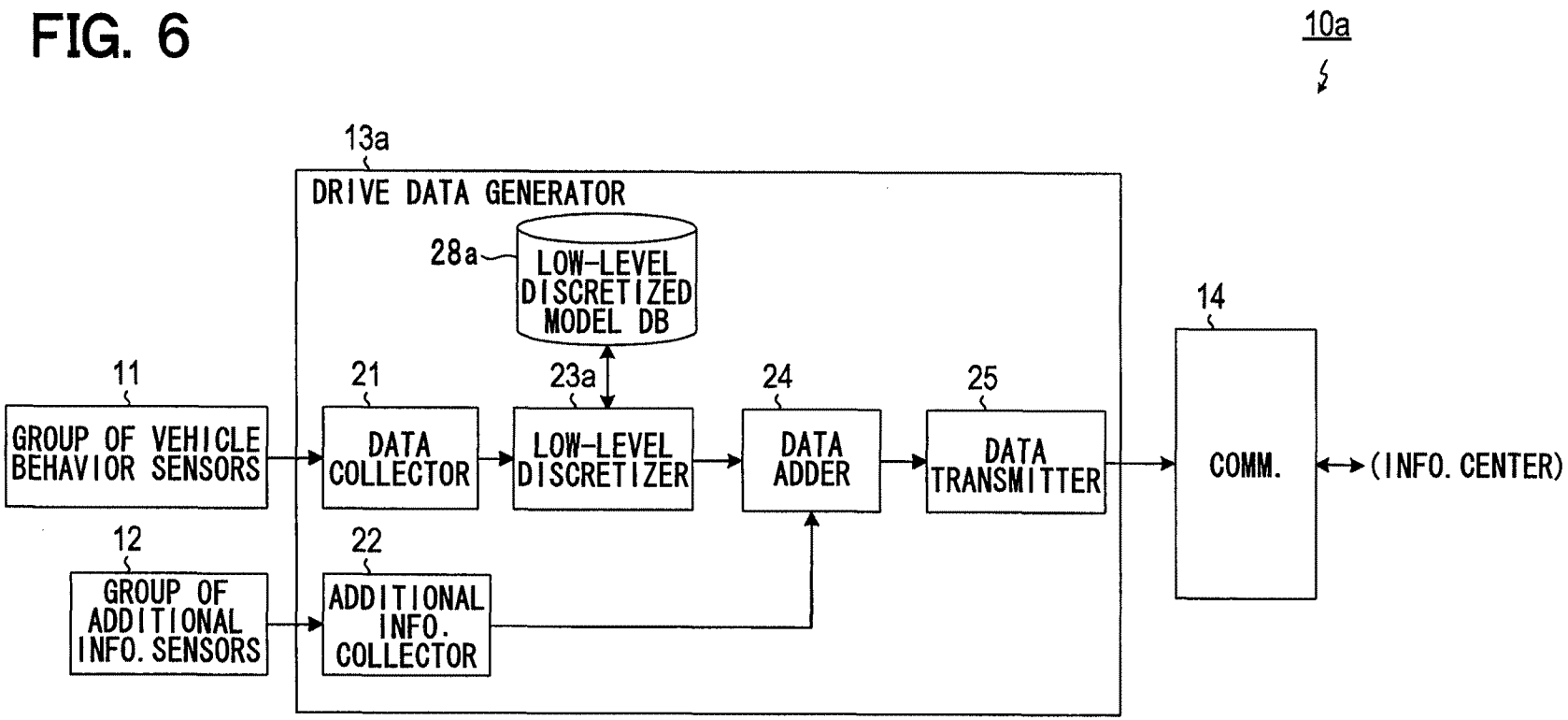
FIG. 6 is a block diagram of the in-vehicle system in the second embodiment of the present disclosure.

The in-vehicle system 10*a* is provided with the group of vehicle behavior sensors 11, the group of additional information sensors 12, a drive data generator 13*a*, and the communicator 14 as shown in FIG. 6. That is, in other words, the same configuration as the in-vehicle system 10 of the first embodiment except for the drive data generator 13*a* is used in the second embodiment.

The drive data generator 13*a* is, compared with the drive data generator 13 described in FIG. 2, different in that it has the model receiver 26 and the model updater 27 omitted from the system 10*a*, and has a low-level discretizer 23*a* and a low-level discretized model DB 28*a* instead of having the data discretizer 23 and the discretized model DB 28.

The low-level discretizer 23*a* performs only the first half of the process performed by the data discretizer 23 in the first embodiment, (i.e., the generation of the series of symbols). That is, the low-level discretizer 23*a* outputs the series of symbols shown in FIG. 3 to the data adder 24 as the discretized drive data.

The low-level discretized model DB 28*a* memorizes, as the low-level model information, the clusters and the transition probability between the clusters that are used for the generation of the series of symbols by the low-level discretizer 23*a*. The low-level model information contains fix values that are mainly set according to the characteristics of the group of vehicle behavior sensors 11, or the like.

[Information Center]

Figure 7:
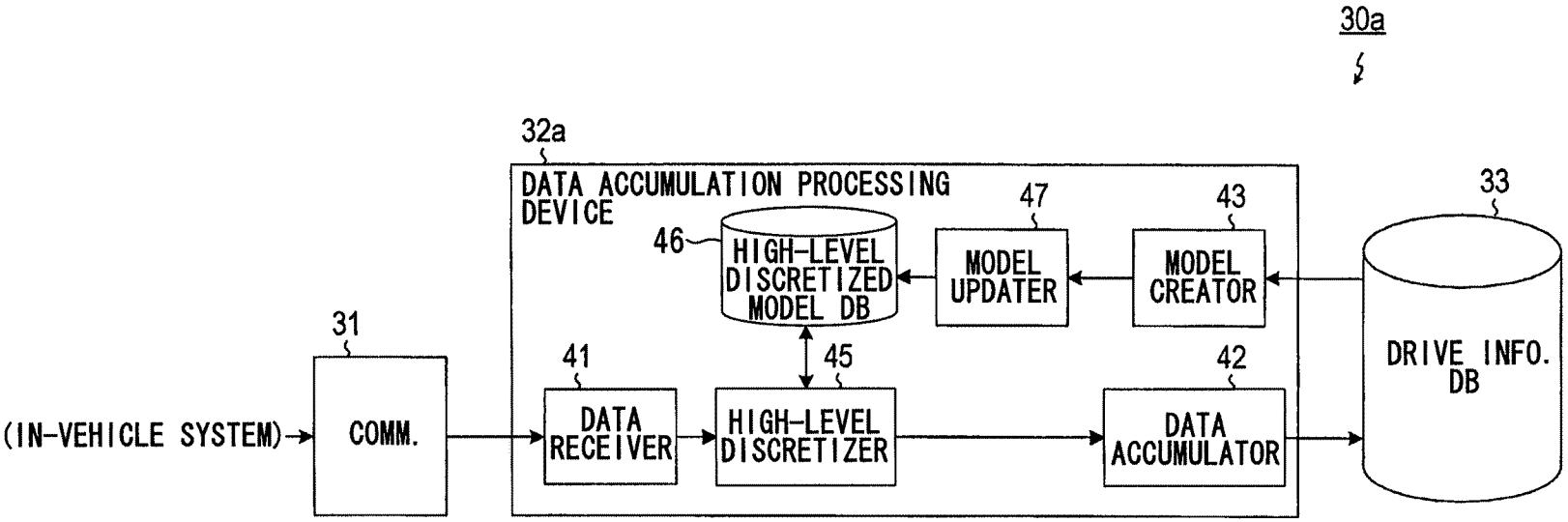
FIG. 7 is a block diagram of the information center in the second embodiment of the present disclosure.

The information center 30*a* is provided with the communicator 31, a data accumulation processing device 32*a*, and the drive information DB 33 as shown in FIG. 7. That is, in other words, the same configuration as the information center 30 of the first embodiment is used except for the data accumulation processing device 32*a*.

The data accumulation processing device 32*a* is, compared with the data accumulation processing device 32 in FIG. 4, different in that it has the model transmitter 44 omitted from the data accumulation processing device, and has a high-level discretizer 45, a high-level discretized model DB46, and a model updater 47 added to the accumulation processing device 32*a*.

The high-level discretizer 45 performs only the second half of the process performed by the data discretizer 23 in the first embodiment (i.e., the articulation of the series of symbols). That is, the discretized drive data transmitted from the in-vehicle system 10*a* corresponds to the series of symbols shown in FIG. 3, and by articulating the series of symbols, the same data as the output from the data discretizer 23 of the first embodiment is obtained, and such data is then supplied to the data accumulator 42.

The high-level discretized model DB 46 memorizes, as the high-level model information, the transition probability between the partial series and the generation probability of the partial series that are respectively used for the articulation of the series of symbols by the high-level discretizer 45.

The model updater 47 updates the contents of memorized data in the high-level discretized model DB46 by the high-level model information generated by the model creator 43.

[Effects]

As described above, according to the drive data collection system 1*a*, the same effects as the system 1 are achieved. Further, processing load of the in-vehicle system 10*a* in each of the vehicles is lightened. Furthermore, the discretized model is divided into the high-level model that is updatable and the low-level model that has the fixed values, the above-described same effects are achievable without sending the low-level model information from the information center 30*a* to the in-vehicle system 10*a*, which is beneficial in reducing the communication amount over the network and reducing the system production cost of the in-vehicle system.

(Third Embodiment)

Since the system configuration in the third embodiment is fundamentally the same as the second embodiment, the same part between the two embodiments is omitted from the following description, and a focus of the description in put on the difference between the second embodiment and the third embodiment.

[Configuration]

Figure 8:
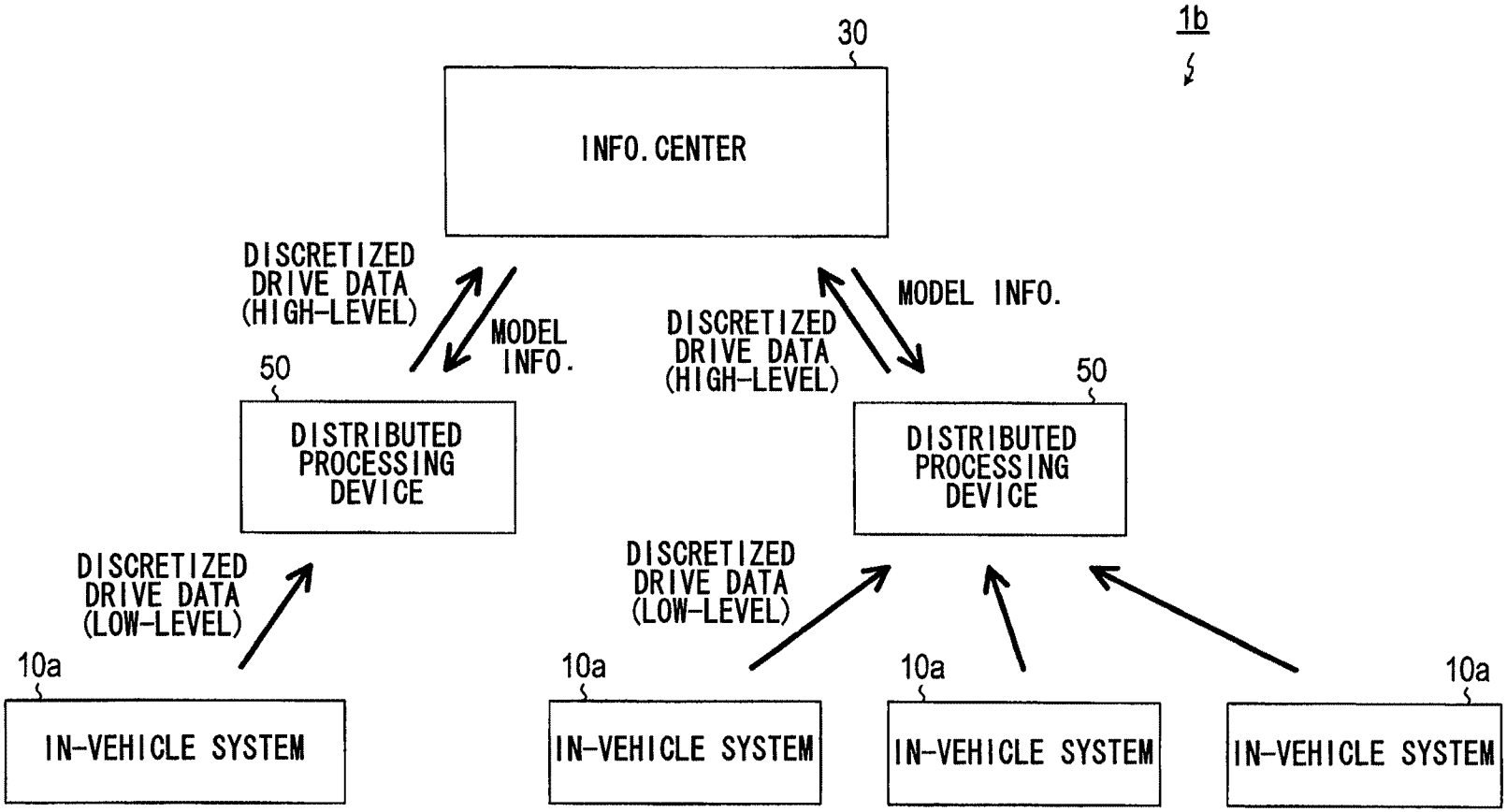
FIG. 8 is a block diagram of the performance data collecting system of the third embodiment of the present disclosure.

A drive data collection system 1*b* shown in FIG. 8 is provided with the in-vehicle system 10*a* in each of the vehicles, and a distributed processing device 50 that is capable of communicating with the in-vehicle system 10*a* and the information center 30 that is capable of communicating with the distributed processing device 50. In other words, the in-vehicle system 10*a* is the same as the second embodiment, and the distributed processing device 50 is newly added to the system 1*b*.

[Distributed Processing Device]

Figure 9:
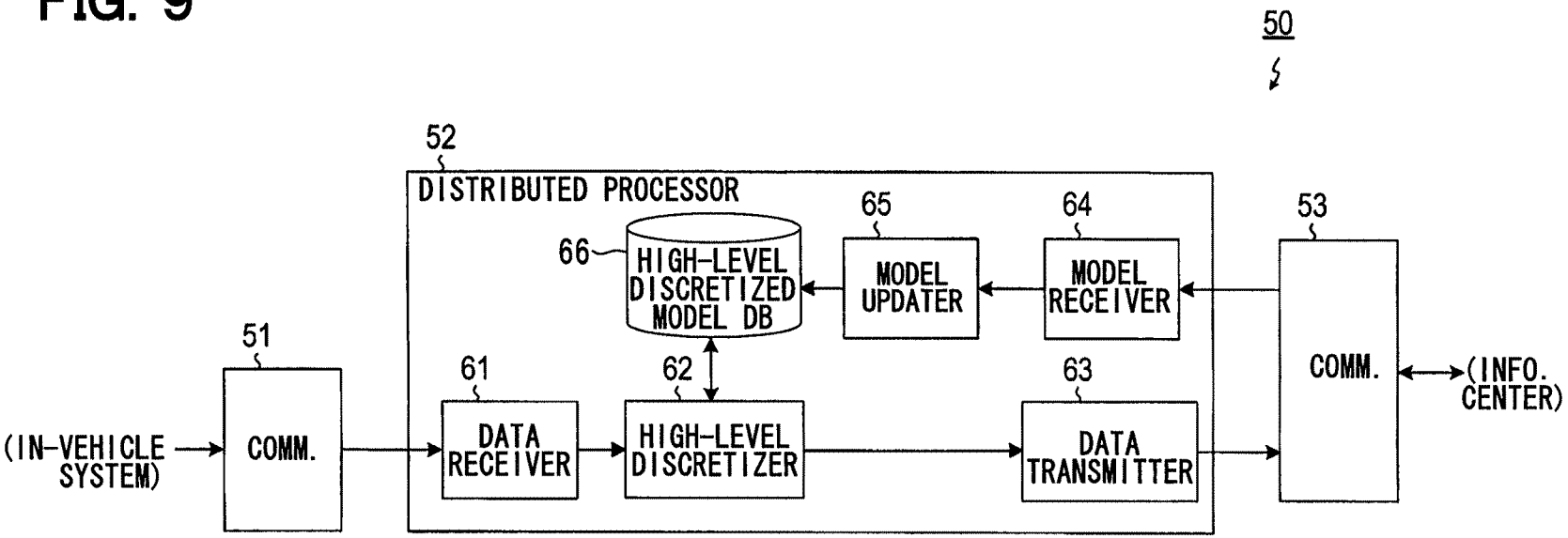
FIG. 9 is a block diagram of a distributed processing device of the third embodiment of the present disclosure.

The distributed processing device 50 is provided with a communicator 51, a distributed processor 52, and another communicator 53 as shown in FIG. 9.

The communicator 51 realizes communication with the in-vehicle system 10*a*, and the other communicator 53 realizes communication with the information center 30. The communicators 51 and 53 (e.g., transmitters) may be configured to perform a direct communication with the destination of the communication, or may be configured to perform communication with the destination via the public communication network.

The distributed processor 52 is provided with a data receiver 61, a high-level discretizer 62, a data transmitter 63, a model receiver 64, a model updater 65, and a high-level discretized model DB 66. The distributed processor 52 is realized as a device such as a microcomputer including CPU, ROM, and RAM. The high-level discretized model DB 66 is stored in the RAM. Further, each of the other components 61 to 65 is respectively realized by a process that is executed by the CPU according to a stored program in the ROM.

The data receiver 61 receives the discretized drive data (i.e., the series of symbols) from the in-vehicle system 10*a* via the communicator 51.

The high-level discretizer 62 and the high-level discretized model DB 66 are the same as the high-level discretizer 45 and the high-level discretized model DB46 of the second embodiment (refer to FIG. 7).

The data transmitter 63 transmits the discretized drive data (i.e., the articulated series of symbols) outputted from the high-level discretizer 62 to the information center 30 via the communicator 53.

The model receiver 64 receives the high-level model information from the information center 30 via the communicator 53. The model updater 65 updates the contents of memory in the high-level discretized model DB 66 with the high-level model information that is received by the model receiver 64.

Further, the distributed processing device 50 may be installed in a facility outside of a vehicle, just like the information center 30, or may be disposed in some of the many vehicles which have sufficient/abundant processing power. The distributed processing device 50 of both types may be used at the same time.

[Effects]

As described above, according to the drive data collection system 1*b*, the same effects as the first and the second embodiments, (i.e., the same effects as the drive data collecting systems 1 and 1*a* are achievable).

Further, according to the drive data collection system 1*b*, compared with the second embodiment, a concentration of the processing load to the information center 30 is controlled or mitigated by having the distributed processing device 50.

(Other Embodiments)

As mentioned above, although the embodiments of the present disclosure are described, the present disclosure may take various forms, without being limited to the above-mentioned embodiments.

(1) Although the DAA method is used in the above-mentioned embodiments as a technique for discretization of the drive data, the discretization method is not necessarily limited to such method (i.e., any publicly-known technique using certain model information can also be used for discretization).

(2) The function of one element in the above embodiments may be collectively performed by plural elements, or the function collectively performed by plural elements may be performed by only one element.

Further, a part of the above embodiment may be replaced with a publicly-known configuration having the same function. Further, a part of the above embodiment may be omitted. Further, a part of the above embodiment may be added to the other embodiment, or replaced with a part of the other embodiment. In other words, the language in the claims serves as a basis for and a core of the technical thought in the present disclosure.

(3) Beside the above-described drive data collection system, the system of the present disclosure may also be realized as a collection of systems, one of which is the drive data collection system concerned, or may also be realized as an in-vehicle system having the entire functionality of the drive data collection system, or may also be realized as an information center, or as a program for operating a computer as the distributed processing device, or as a storage medium storing such a program, or a method for collecting the drive data or the like. That is, the present disclosure may be implemented in various forms of systems, programs and/or method concerned.

Further, the systems, programs, or methods are to be understood as being within the scope of the present disclosure as defined by appended claims.

What is claimed is:

1. A drive data collection system, the drive data collection system comprising:

an in-vehicle system installed in a vehicle, the in-vehicle system including a data collector configured to collect measurement values indicative of various indexes regarding a state of a subject vehicle that has the in-vehicle system installed in the subject vehicle, a model memory configured to store model information regarding discretization rules for discretizing drive data into multiple data parts, the drive data includes time-series measurement values collected by the data collector, and the model information is shared by each of participating vehicles in the drive data collection system, and a Double Articulation Analyzer configured to continuously discretize the drive data into the multiple data parts using a double articulation dividing method according to the model information; and an information center configured to communicate with the in-vehicle system, the information center including a data accumulator configured to accumulate the discretized drive data in a server, wherein the in-vehicle system is configured to send the discretized drive data to the information center via communication through a communicator.

2. The drive data collection system of claim 1, wherein the information center includes a model creator configured to create the model information based on the discretized data accumulated in the server, the in-vehicle system includes a model updater configured to update stored contents of the model memory by using the model information created by the model creator, and the information center configured to distribute the model information to the in-vehicle system via communication through another communicator.

3. A drive data collection system, the drive data collection system comprising:

an in-vehicle system installed in a vehicle, the in-vehicle system including a data collector configured to collect measurement values of various indexes regarding a state of a subject vehicle that has the in-vehicle system installed in the subject vehicle, a low-level model memory configured to store low-level model information regarding discretization rules for discretizing drive data into multiple data parts, the drive data collected by the data collector as time-series measurement values, and a low-level Double Articulation Analyzer configured to continuously discretize the drive data into the multiple data parts using a double articulation dividing method by using the low-level model information; and an information center configured to communicate with the in-vehicle system, the information center including:

a high-level model memory configured to store high-level model information regarding integration rules for integrating the discretized drive data continuously discretized by the low-level discretizer, a high-level discretizer configured to integrate the discretized drive data according to the high-level model information, and a data accumulator configured to accumulate the integrated discretized drive data in a server.

4. The drive data collection system of claim 3, wherein the information center includes:

a model creator configured to create the high-level model information based on the integrated discretized drive data accumulated in the server; and a model updater configured to update stored contents of the high-level model memory with the high-level model information created by the model creator.

5. A drive data collection system, the drive data collection system comprising:

an in-vehicle system installed in a vehicle, the in-vehicle system including a data collector configured to collect measurement values of various indexes regarding a state of a subject vehicle that has the in-vehicle system installed in the subject vehicle, a low-level model memory configured to store low-level model information regarding discretization rules for discretizing drive data into multiple data parts, the drive data including time-series measurement values collected by the data collector, and a low-level Double Articulation Analyzer configured to continuously discretize the drive data using a double articulation dividing method according to the low-level model information;

a distributed processing device, each of the distributed processing device including a high-level model memory configured to store high-level model information regarding integration rules for integrating the discretized drive data discretized by the low-level discretizer, a high-level discretizer configured to integrate the discretized drive data according to the high-level model information stored in the high-level model memory, and a model updater configured to update contents of the high-level model memory with the high-level model information created by the model creator; and an information center configured to communicate with the in-vehicle system, the information center including a data accumulator configured to accumulate the integrated discretized drive data in a server, and a model creator configured to create the high level model information based on the integrated discretized drive data accumulated in the server, wherein the distributed processing device is configured to communicate with both of the in-vehicle system and the information center.

6. The drive data collection system of claim 5, wherein the distributed processing device is installed in a part of participating vehicles in the system.

7. The drive data collection system of claim 1, wherein the in-vehicle system further includes:

an additional information collector configured to collect additional information regarding a situation in which the subject vehicle has the in-vehicle system installed in the subject vehicle; and a data adder configured to add the additional information collected by the additional information collector to data that is to be sent to the information center.

8. The drive data collection system of claim 1, wherein the double articulation dividing method includes:

gathering clusters representing vehicle states based on the drive data in a multi-dimensional space to depict value ranges of the drive data;

defining transition probabilities between the clusters; and statistically determining which one of the clusters the drive data obtained from the data collector belongs to, based on the clusters and the transition probabilities.

9. The drive data collection system of claim 3, wherein the double articulation dividing method includes:

gathering clusters representing vehicle states based on the drive data in a multi-dimensional space to depict value ranges of the drive data;

defining transition probabilities between the clusters; and statistically determining which one of the clusters the drive data obtained from the data collector belongs to, based on the clusters and the transition probabilities.

10. The drive data collection system of claim 5, wherein the double articulation dividing method includes:

gathering clusters representing vehicle states based on the drive data in a multi-dimensional space to depict value ranges of the drive data;

defining transition probabilities between the clusters; and statistically determining which one of the clusters the drive data obtained from the data collector belongs to, based on the clusters and the transition probabilities.

* * * * *